US009073300B2

(12) United States Patent
Moore

(10) Patent No.: US 9,073,300 B2
(45) Date of Patent: Jul. 7, 2015

(54) IMAGING APPARATUS, SYSTEMS, AND METHODS USEFUL IN INK-BASED DIGITAL PRINTING

(75) Inventor: Steven R. Moore, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 109 days.

(21) Appl. No.: 13/476,395

(22) Filed: May 21, 2012

(65) Prior Publication Data

US 2013/0305944 A1 Nov. 21, 2013

(51) Int. Cl.

| | |
|---|---|
| ***B41F 7/30*** | (2006.01) |
| ***B41F 7/02*** | (2006.01) |
| ***B41M 1/06*** | (2006.01) |
| *B41F 13/22* | (2006.01) |
| *B41C 1/10* | (2006.01) |

(52) U.S. Cl.
CPC . *B41F 7/02* (2013.01); *B41F 13/22* (2013.01); *B41C 1/1008* (2013.01); *B41M 1/06* (2013.01)

(58) Field of Classification Search
CPC ..... B41F 31/002; B41F 7/30; B41M 1/06; B41M 5/0047; B41C 1/003; B41C 1/1008
USPC ..... 101/450.1, 487, 142, 483, 491, 492, 101/465, 467, 451; 347/103
See application file for complete search history.

(56) References Cited

U.S. PATENT DOCUMENTS

| | | | | |
|---|---|---|---|---|
| 6,767,092 | B2 * | 7/2004 | May et al. | 347/103 |
| 6,783,228 | B2 * | 8/2004 | Szumla et al. | 347/103 |
| 2009/0064884 | A1 * | 3/2009 | Hook et al. | 101/450.1 |

* cited by examiner

*Primary Examiner* — Daniel J Colilla
*Assistant Examiner* — Quang X Nguyen
(74) *Attorney, Agent, or Firm* — Ronald E. Prass, Jr.; Prass LLP

(57) ABSTRACT

An imager apparatus useful for a digital lithographic printing system includes imaging roll configured to be heated to a first temperature. The imager apparatus may include one or more heating elements for heating the imaging roll to the first temperature within one revolution. The imaging roll may be about the same width as an imaging plate in a cross-process direction, the imaging plate and the imaging roll being configurable for forming an imaging nip in a digital lithographic ink printing system. The imager apparatus may include a solution ejecting mechanism such as a printhead for ejecting fountain solution or water at ambient temperature onto a surface of the imaging roll according digital image data.

12 Claims, 3 Drawing Sheets

IMAGING APPARATUS, SYSTEMS, AND METHODS USEFUL IN INK-BASED DIGITAL PRINTING

FIELD OF DISCLOSURE

The disclosure relates to ink-based digital printing or digital architecture printing systems for printing with lithographic ink. In particular, the disclosure relates to thermal contact imaging systems having an imaging roll forming a nip with an imaging plate of a central imaging drum of a digital lithographic ink printing system.

BACKGROUND

A digital offset or digital architecture printing system may be used for variable data ink-based printing. In digital offset printing processes, a thin layer of fountain solution is evenly applied across a surface of a light energy-absorptive imaging plate or blanket, which may be arranged on an outer portion of a rotatable imaging drum or cylinder. The rotatable imaging cylinder may be configured to bring regions of the imaging plate surface to pass adjacent subsystems or processing stations, including: a dampener for applying the fountain solution; an imaging system for imaging or image-wise vaporization of fountain solution from select regions of the imaging plate; an inker for applying ink to the imaging plate surface; a transfer station from which an ink image is transferred to a printable medium; and a cleaner system for removing residue from a surface of the image plate and preparing the surface to begin the process anew.

After applying fountain solution to an imaging plate in an ink-based digital printing process, an imaging system having of a high power laser may be used to image-wise vaporize fountain solution from select regions of the plate surface. The imaging plate is configured to absorb light energy for heating and locally boiling off fountain solution from the plate surface. A modulated light source such as a high power laser may be implemented to selectively vaporize fountain solution at regions on the plate where ink is to adhere to form an ink image in accordance with digital image data. A suction manifold may be implemented for removing fountain solution vapor from the imaging zone. Ink may be applied by the inker, and may adhere to the select regions of the imaging plate from which fountain solution has been vaporized to form an ink image. Conversely, ink may be rejected by regions of the imaging plate surface where fountain solution remains. The ink image may be transferred at the transfer station to paper or other suitable media by way of pressure.

Related art imaging systems for digital lithographic ink printing are expensive to manufacture. Related imaging systems include a high power light source such as an infrared ("IR") laser, and alternative fountain solutions having lower heats of vaporization are used in an effort to minimize the optical power requirement.

SUMMARY

Related high power laser-based imaging systems having IR laser light sources are costly. Although water-based fountain solutions are desirable for use in lithographic ink printing, their high latent heat of vaporization of water necessitates prohibitively large amounts of power to be applied during an imaging step. A one color 24" wide process running at 2 m/s may require a minimum incident power delivery from the imager of 6.3 KW to evaporate a 2 um thick water film, for example. Thinner fountain solution layers and alternative fountain solution materials having lower heat of vaporization have been developed to mitigate such costs. Thermal contact imaging apparatus, systems, and methods are provided that accommodate energy and cost savings compared to related art systems.

In an embodiment, apparatus may include a thermal contact imaging apparatus useful for digital lithographic ink printing. The thermal contact imaging apparatus may include an imaging roll and a drop ejecting system configured to eject a solution onto a surface of the imaging roll for selectively cooling the surface of the imaging roll. Apparatus may include at least one external heating element configured to heat the imaging roll surface to a first temperature. Apparatus may include at least one internal heating element configured to heat the imaging roll surface to a first temperature. Apparatus may include the drop ejecting system configured to eject the solution at ambient temperature or otherwise a temperature sufficient to locally cool the imaging roll surface to a second temperature, the second temperature being lower than the first temperature.

In the embodiment, the temperature of the solution may be lower than the first temperature of the heated imaging roll, wherein the solution contacts desired portions of the imaging roll surface in accordance with digital image data. The desired portions of the imaging roll surface correspond to portions of an imaging plate from which ink applied to the imaging plate surface is to be rejected for forming an ink image in a digital lithographic ink printing process. In an embodiment, the solution may comprise a water based solution. In an embodiment, at least one heating element may be included for heating the imaging roll, the at least one heating element and the imaging roll being configured to heat the imaging roll surface to a first temperature within one revolution of the imaging roll.

In an embodiment, apparatus may include the at least one heating element and the imaging roll being configured to heat the surface of the imaging roll to a first temperature, the drop ejecting system being configured to deposit the solution at select regions of the imaging roll surface so that the select regions of the imaging roll surface are cooled to a second temperature that is lower than the first temperature, the surface regions at the first temperature and the surface regions at the second temperature forming a latent thermal image. The drop ejecting system may comprise a printhead. The printhead may be connected to a data source for controlling the printhead in accordance with digital image data.

In an embodiment of systems, a digital lithographic printing system or ink-based digital printing system may include an imaging apparatus for selectively patterning a fountain solution or water-based solution film, the imaging apparatus having an imaging roll; and an imaging plate of an imaging cylinder forming an imaging nip with the imaging roll of the imaging apparatus, the imaging plate configured for carrying the fountain solution or water-based solution film to the imaging nip. In an embodiment, a drop ejecting mechanism may be configured for ejecting solution onto the imaging roll to form a thermal latent image for the selectively patterning of the fountain solution or water-based solution film. In an embodiment of systems, the imaging apparatus may be configured to heat the imaging roll to a first temperature, the drop ejecting system being configured to eject the solution onto select portions of the imaging roll surface in accordance with digital image data to cool the select portions of the imaging roll to a second temperature, the second temperature being less than the first temperature.

In an embodiment of systems, the imaging apparatus may include at least one heating element for heating the imaging roll, the at least one heating element and the imaging roll being configured to heat the imaging roll surface to a first temperature within one revolution of the imaging roll. Systems may include the drop ejecting mechanism including a printhead. The printhead may be connected to a data source for communicating and/or controlling the printhead in accordance with digital image data. In an embodiment, systems may include an inking system for inking the imaging plate after the selectively patterning the fountain solution or water-based solution film. In an embodiment, systems may be configured so that the ink adheres to portions of the imaging plate contacted at the imaging nip by the select regions of the imaging roll cooled to the second temperature.

In an embodiment of methods, a thermal contact imaging process useful for digital lithographic ink printing may include heating a surface of an imaging roll to a first temperature; and ejecting fountain solution to select portions of the surface of the imaging roll forming a thermal latent image comprising regions of the first temperature and regions of the second temperature. In an embodiment, the ejecting may be carried out in accordance with digital image data, the solution being ejected by a printhead connected to a controller. In an embodiment, methods may include transferring thermal energy from the imaging roll surface regions remaining at the first temperature, i.e., regions onto which no solution was ejected, to a fountain solution film formed on an imaging plate for selectively removing fountain solution from regions of the imaging plate at which ink is to be deposited and adhere for forming an ink image.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
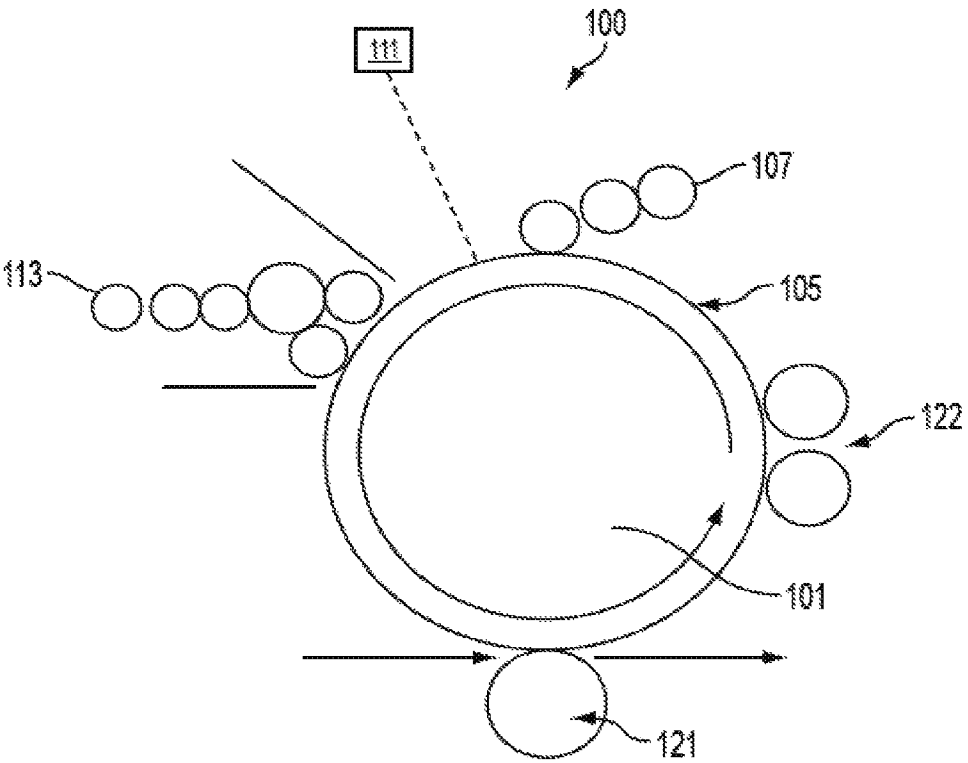
FIG. 1 PRIOR ART
FIG. 1 shows a diagrammatical side view of a digital architecture printing system and processes.

Exemplary embodiments are intended to cover all alternatives, modifications, and equivalents as may be included within the spirit and scope of the apparatus and systems as described herein.

Reference is made to the drawings to accommodate understanding of apparatus, systems, and methods for digital architecture printing using a thermal contact imaging roll imaging system. In the drawings, like reference numerals are used throughout to designate similar or identical elements. The drawings depict various embodiments related to embodiments of illustrative apparatus, and systems for digital architecture printing using lithographic inks.

A digital offset or digital architecture printing system may be used for variable data printing with lithographic inks. FIG. 1 shows a digital offset or digital architecture printing system 100 for printing on media such as paper cut sheets, paper webs, and/or other material suitable for printing with lithographic ink. System 100 may include an imaging member such as cylinder 101. The imaging cylinder 101 may include an imaging plate 105 formed on an outer portion of the cylinder 101. The plate may be formed of either a natural or synthetic elastomer. In related art systems, the plate is configured to absorb light energy to accommodate an imaging process wherein light energy is focused onto select regions of the plate surface to locally boil off fountain solution located thereon. Thermal contact imaging apparatus, systems, and methods of embodiments obviate the need for light absorption functionality for the imaging plate.

The imaging cylinder 101 may be rotatable in a process direction corresponding to the imaging cylinder arrow shown in FIG. 1 for bringing regions of the imaging plate 105 surface to pass adjacent subsystems, including: a dampener or fountain solution system 107 for applying fountain solution to a surface of the imaging plate 105; a related imager system 111 for image-wise vaporization of fountain solution from select regions of the imaging plate 105 using a line laser source; an inker 113 for applying ink to the imaging plate 105 surface; a transfer station 121 from which an ink image is transferred under pressure to a printable medium such as paper; and a cleaner system 122 for removing residue from a surface of the imaging plate 105 and preparing the imaging plate 105 surface for beginning the process anew.

In a digital lithographic printing process using the system shown in FIG. 1, an imaging cylinder 101 having an elastomer imaging plate 105 may be dampened with a uniform thin film of fountain solution. A high power modulated light source may be used to selectively vaporize the fountain solution at regions of the imaging plate 105 where image content is desired. Fountain solution vapor may be diverted from the imaging zone to prevent interference with the imaging process using a suction manifold or similar device. A rotatable imaging cylinder 101 may cause the imaging plate 105 to pass an inker nip. The inker nip may include the inker 113, which may be configured to deposit ink on the plate 105 whereby the ink adheres to portions of the plate from which fountain solution has been vaporized. One or more UV lamps may be used to partially cure the ink on the plate in order to enhance transfer at transfer station 121. A resulting ink image on the imaging plate 105 may be transferred to media by way of pressure at a transfer nip. If transfer efficiency is not substantially near 100%, a cleaning system may be configured to remove residual ink from the plate 105.

Limiting characteristics of digital lithographic ink printing systems including related art imaging systems includes the amount of power required to evaporate fountain solution. Although water-based fountain solution is typical in the lithographic industry and preferred for its low cost, the high latent heat of vaporization of water entails substantial power requirements. Manufacturing an imager that uses infrared laser light sources capable of meeting these power requirements is prohibitively expensive. A related art imager may include a line laser source, a micro-mirror modulator array, and projection optics systems wherein light energy from the laser is pixel-wise reflected off of individual micro-mirrors, and then focused by optics onto an image plane at a top surface of an imaging plate 105. Light energy may be absorbed by the plate 105 to cause the fountain solution to locally heat and boil off. Unless extremely thin fountain solution layers can be evenly applied to a surface, any water-based fountain solution is limited in its process speed. As such, alternative fountain solution materials having lower latent heats of vaporization have been considered, which entail higher costs and possibly unique health and environmental concerns related to their use.

Thermal contact imaging apparatus, systems, and methods provided replace related art laser-based imaging systems with an imaging roll. An imagine roll surface material may be configured to have particular mechanical and thermal characteristics. The roll may be configured so that the surface may be heated to temperature above a fountain solution boiling point, and may be maintained continuously at this temperature by way of a temperature control system. The temperature control system may include one or more heating elements connected to the roll, and/or a water-based internal roll heating system. The imaging roll of the thermal contact imaging system may be configured to contact a printing plate such as the imaging plate 105 show in FIG. 1 at an imaging nip formed by the imaging roll and the imaging plate. With respect to a process direction, prior to the imaging nip, a full width array printhead may be configured and positioned so that the printhead can eject fountain solution or water dropwise onto a surface of the imaging roll. The ejected fountain solution may be heated and vaporized as it contacts the heated imaging roll, drawing thermal energy from and locally cooling the imaging roll surface. Accordingly, the imaging roll surface may be locally cooled wherever drops land on the roll.

By placing the printhead sufficiently close to the imaging nip formed by the imaging roll and the imaging plate, a surface temperature of the imaging roll may be patterned with a series of cool spots corresponding to pixels against a background of hotter regions of the imaging roll surface. As this pattern surface or thermal latent image enters the imaging nip, a fountain solution film applied to the imaging plate may be vaporized at portions of the imaging plate that contact the hotter background portions of the imaging roll surface. Fountain solution is not vaporized where cooler spots have been patterned, which correspond to locations where fountain solution or water has been ejected onto the imaging roll by the printhead. At an exit site of the imaging nip, internal and/or external heaters may thermally reset the imaging roll surface to a uniform high temperature. An imaging roll may be configured to have a compliant surface so that a uniform nip contact may be achieved along a cross-process direction. Thermal contact imaging apparatus, systems, and methods accommodate lower cost imager systems and high speed operation with water-based fountain solutions.

Figure 2:
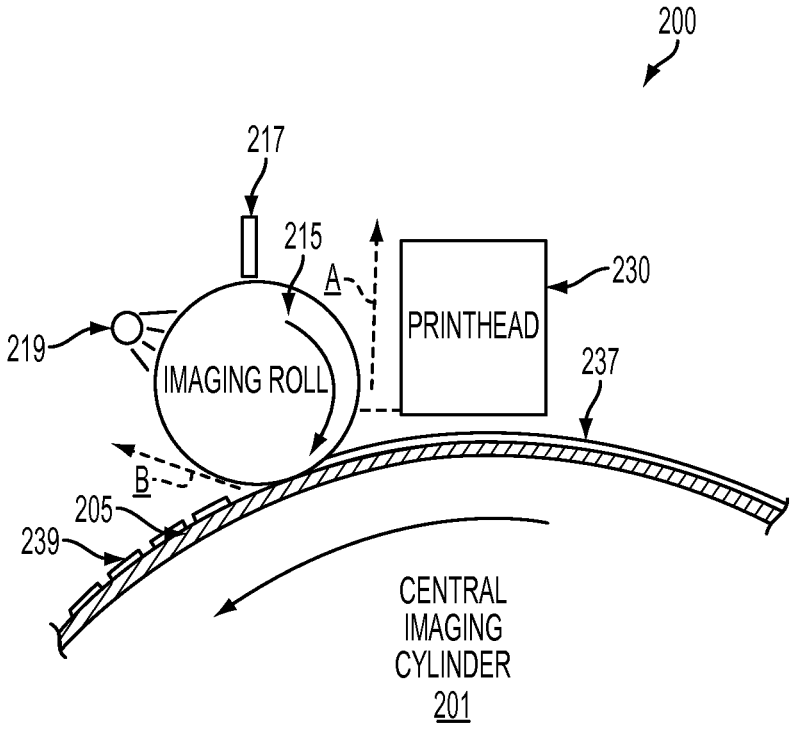
FIG. 2 shows a diagrammatical perspective view of a digital architecture imaging system in accordance with an exemplary embodiment.

Thermal contact imaging apparatus and systems in accordance an embodiment is shown in FIG. 2. In particular, FIG. 2 shows a digital lithographic ink printing system and imaging system in accordance with apparatus and systems. The digital lithographic printing system 200 shown in FIG. 2 includes a central imaging cylinder 201 rotatable in a process direction corresponding to the central imaging cylinder arrow shown in FIG. 2. The central imaging cylinder 201 includes an imaging plate 205. The imaging plate 205 may be formed of a natural or synthetic elastomer or other material suitable for lithographic ink printing. Imaging apparatus, systems, and methods of embodiments do not require that the imaging plate be formed of light absorptive material.

Apparatus and systems may include an imaging roll 215. The imaging roll may be rotatable in process direction corresponding to the imaging roll arrow shown in FIG. 2. The imaging roll 215 may be formed to have a process width that is about equal to a process width of the imaging plate 205. The imaging roll 215 may be connected to and/or arranged adjacent to one or more external and/or internal heating elements, and/or one or more temperature sensors. FIG. 2 shows an external heating element 219 arranged to heat the imaging roll 215. The heating element 219 and the imaging roll 215 may be arranged and configured to cause the imaging roll 215 to be heated to a high temperature Tp within one revolution of the imaging roll 215. The imaging roll 215, the heating element 219, one or more temperature sensors 217, and/or one or more connected controllers (not shown) may be configured to increase a temperature of the imaging roll 215 surface to a high temperature Tp wherein Tp is higher than a fountain solution boiling point. The imaging roll 215 may be configured to have a compliant surface, and may be arranged to form a nip with the imaging plate 205. During a lithographic ink printing process, the imaging roll 215 is in intimate contact with the fountain solution layer formed on the surface of the imaging plate 205. During such contact, heat energy may be conducted into the fountain solution film causing the fountain solution to approach temperature Tp and vaporize from the imaging plate 205 surface.

A printhead 230 may be arranged adjacent to the imaging roll 215. The printhead 230 may be a full width array printhead, or may be a series of partial width array printheads. The printheads may be configured to eject fountain solution or a water-based solution onto the imaging roll 215 surface. In accordance with digital data, the printhead 230 may be configured to eject the fountain solution onto the imaging roll 215 surface to form a thermal latent image corresponding to an image background area, i.e., a "white write" image. As each drop of ejected fluid strikes the imaging roll 215 surface, the drop is rapidly heated beyond its boiling point, and evaporates. The energy for this phase transformation is provided from the imaging roll surface, which results in a local cool zone on the imaging roll surface, e.g., a region at an average temperature Tc, to exist where the drop landed. It is desirable that the Tc is below the boiling point of the fountain solution, and this may be adjusted as desired by configuring imaging roll thermal properties and drop mass. The locally cooled regions of the imaging roll 215 surface may be rotated into the nip formed by the imaging roll 215 and the imaging plate 205. Fountain solution film on the printing plate 205 may split at the imaging nip wherein about half of the fountain solution remains on the imaging plate 205. This may occur at locations wherein the imaging roll surface has been locally cooled to a temperature Tc. Locations on the printing plate 205 that correspond to areas where drops landed on the imaging roll 215 surface will reject ink at a downstream inker station, and correspond to image background. Conversely, regions or zones of the imaging roll 215 surface that did not receive drops from the printhead 230 will remain at high temperature Tp, and as these regions pass through the imaging nip, it will transfer sufficient heat energy to the fountain solution film on the imaging plate 205 to cause the film to locally heat and evaporate. Airflow and/or vacuum suction may be provided as diagrammatically shown in FIG. 2 to evacuate vapor generated from the imaging roll 215 upstream from the imaging nip and from the imaging plate 205 downstream of the imaging nip.

Several properties of the imaging roll 215 surface and imaging roll 215 core may influence a thermal signature of a particular roll as the roll enters the imaging nip during a lithographic ink printing process. For example, a roll surface that has low lateral thermal conductivity may be preferred. A temperature and drop mass of jetted drops may also affect system design.

Figure 3:
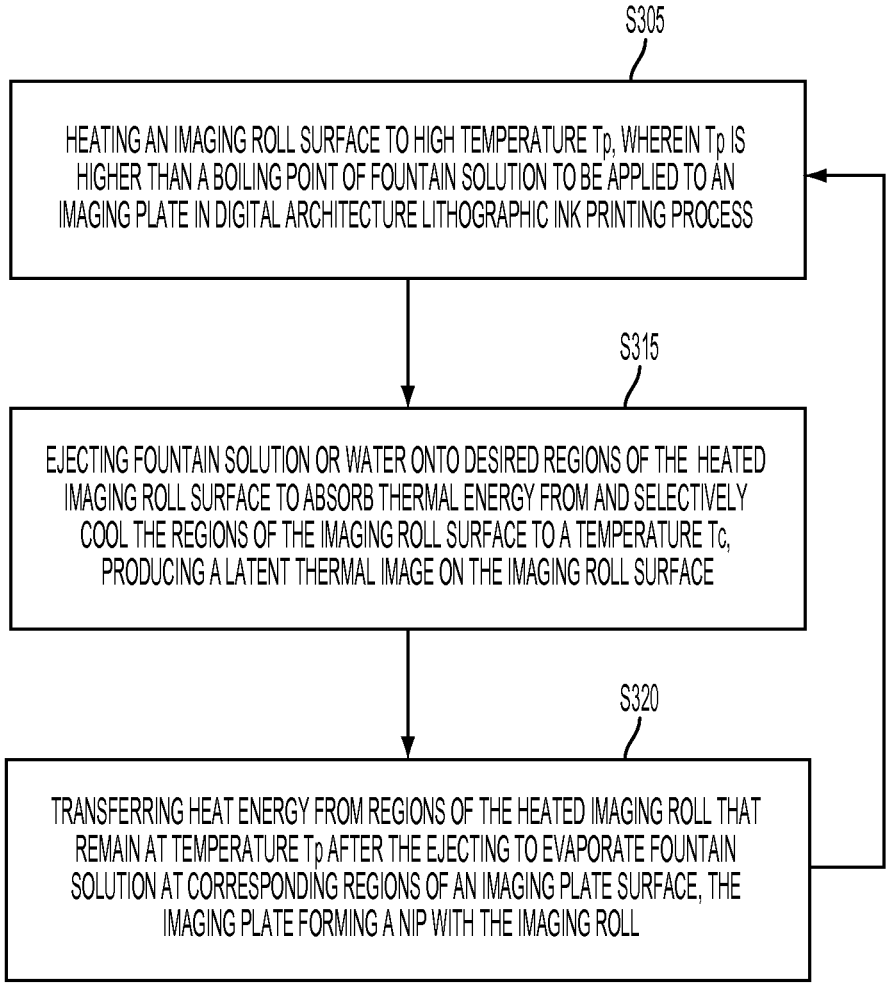
FIG. 3 shows digital lithographic ink printing methods in accordance with an exemplary embodiment.

Digital lithographic ink printing processes including thermal contact imaging using systems and apparatus is shown in FIG. 3. In particular, FIG. 3 shows methods for thermal contact imaging useful in digital lithographic ink printing. Methods of thermal contact imaging for ink-based digital printing may include heating at S305 an imaging roll surface to a high temperature Tp. The high temperature Tp may be a temperature that is higher than a boiling point of a fountain solution and/or water-based solution to be applied to an imaging plate in a digital lithographic ink printing process. Methods may include ejecting at S315 the fountain solution or water-based solution onto desired regions of the heated imaging roll surface. The desired regions of the heated imaging roll surface are selectively cooled as ejected fountain solution lands thereon and absorbs thermal energy. The desired regions are thus cooled to a temperature Tc, producing a latent thermal image on the imaging roll.

With respect to FIG. 2, during a digital lithographic ink printing process, fountain solution or water may be applied by a dampening system to a surface of the imaging plate 205 in a thin even layer. As the imaging plate 205 having the thin layer of fountain solution 237 formed thereon passes through the nip formed by the imaging plate 205 and the imaging roll 215, the latent thermal image formed on the imaging roll and corresponding imaging roll 215 surface regions contact the imaging plate 205 and fountain solution 237. At S320, heat energy is transferred from regions of the heated imaging roll that remain at temperature Tp after the ejecting to evaporate fountain solution at corresponding regions of the imaging plate surface. As such, residual fountain solution 239 remains on the imaging plate 205 as the imaging plate exits the imaging nip in the process direction during the printing process. The residual fountain solution 239 remains on regions of the imaging plate 205 surface that were contacted by corresponding imaging roll 215 surface regions that were cooled to a temperature Tc at S315. The imaging plate 205 surface having the residual fountain solution 239 may be inked by an inker system. The ink may adhere to portions of the imaging plate 205 wherein no fountain solution remains, and may be rejected from regions of the imaging plate 205 where residual fountain solution 239 remains after S305 through S320 as shown in FIG. 3. S305 through S320 may be repeated for further digital ink-based printing.

Digital lithographic ink printing systems including thermal contact imaging apparatus, systems, and methods accommodate reduced manufacturing and process costs. Systems may incorporate known printheads that are substantially less expensive than high power line laser source imaging systems such as are incorporated in related art digital lithographic ink printing systems. Provided apparatus, systems, and methods employ known suitable external and/or internal heating elements that are inexpensive and do not suffer from input power limitations that can strain process speed, the fountain solution material composition options, or fountain solution film thickness. Further, apparatus, systems, and methods are not limited by an infrared absorption requirement for an imaging plate.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A thermal contact imaging apparatus useful for digital lithographic ink printing, comprising:

an imaging roll having a surface to receive a solution;

a heating element arranged to heat the imaging roll to a first temperature (Tp) within one revolution of the imaging roll;

a drop ejecting system configured to eject the solution onto the surface of the imaging roll for selectively cooling the surface of the imaging roll producing a latent thermal image, wherein the heating and application of the solution causes Tp regions and Tc regions on the surface of the imaging roll, wherein Tp regions having the first temperature and Tc regions having a second temperature which is lower than the first temperature;

an imaging plate capable of receiving a fountain solution (FS) film that passes through a nip formed by the imaging plate and the imaging roll;

wherein passage through the imaging nip causes the Tp regions to transfer sufficient heat energy to the FS film on the imaging plate to cause the FS film to evaporate, and wherein the fountain solution film remains on the imaging plate surface that were contacted by corresponding Tc regions of the imaging roll surfaces.

2. The apparatus of claim 1, wherein selectively cooling is drawing thermal energy from the surface of the heated imaging roll.

3. The apparatus of claim 2, the drop ejecting system further comprising the ejected solution being at a temperature sufficient to locally cool the imaging roll surface to a second temperature, the second temperature being lower than the first temperature.

4. The apparatus of claim 2 wherein the at least one heating element and the imaging roll being configured to heat the imaging roll within one revolution of the imaging roll.

5. The apparatus of claim 4, comprising the at least one heating element and the imaging roll being configured to heat the surface of the imaging roll to a first temperature, the drop ejecting mechanism being configured to drop the solution at select regions of the imaging roll surface so that the select regions of the imaging roll surface are cooled to a second temperature that is lower than the first temperature, the surface regions at the first temperature and the surface regions at the second temperature forming a latent thermal image.

6. The apparatus of claim 1, wherein a temperature of the solution is lower than the first temperature of the heated imaging roll, wherein the solution contacts desired portions of the imaging roll surface in accordance with digital image data.

7. The apparatus of claim 6, wherein the desired portions of the imaging roll surface correspond to portions of an imaging plate from which ink applied to the imaging plate surface is to be rejected for forming an ink image in a digital lithographic ink printing process.

8. The apparatus of claim 1, the solution comprising water.

9. The apparatus of claim 1, the drop ejecting mechanism comprising a printhead.

10. A thermal contact imaging process useful for digital lithographic ink printing, comprising:

heating a surface of an imaging roll to a first temperature (Tp); and ejecting a solution onto select portions of the surface of the imaging roll forming a thermal latent image comprising regions of a first temperature (Tp regions) and regions of a second temperature (Tc regions), wherein the second temperature is lower than the first temperature;

receiving a fountain solution (FS) film on an imaging plate, wherein the solution forms an image on the imaging plate when it passes through a nip formed by the imaging plate and the imaging roll;

wherein passage through the imaging nip causes the Tp regions to transfer sufficient heat energy to the FS film on the imaging plate to cause the FS film to evaporate, and wherein the fountain solution film remains on the imaging plate surface that were contacted by corresponding Tc regions of the imaging roll surfaces.

11. The method of claim 10, the ejecting being according to digital image data, the solution being ejected by a printhead.

12. The method of claim 10, comprising:

transferring thermal energy from the imaging roll surface regions at the first temperature to a fountain solution film formed on an imaging plate for selectively removing fountain solution from regions of the imaging plate at which ink is to be deposited for forming an ink image.

* * * * *